US005479862A

United States Patent [19]

Waterkamp

[11] Patent Number: 5,479,862

[45] Date of Patent: Jan. 2, 1996

[54] OVERHEAD CONVEYOR WITH SUPPLEMENTAL WHEEL AND RAIL FOR INCREASING DRIVING TRACTION

[75] Inventor: Holger Waterkamp, Wetter, Germany

[73] Assignee: Mannesmann Aktiengesellschaft, Düsseldorf, Germany

[21] Appl. No.: 172,610

[22] Filed: Dec. 22, 1993

[30] Foreign Application Priority Data

Dec. 23, 1992 [DE] Germany ..... 42 44 445.4

[51] Int. Cl.[6] ..... B61B 3/02

[52] U.S. Cl. ..... 104/93; 104/243; 105/30; 105/150

[58] Field of Search ..... 104/89, 93, 242, 104/243; 105/30, 73, 148, 150

[56] References Cited

U.S. PATENT DOCUMENTS 3,495,545 2/1970 Radovic ..... 104/89

4,644,873 2/1987 Uttscheid ..... 104/93 X 5,092,249 3/1992 Knuettel ..... 105/30

5,241,911 9/1993 Luck et al. ..... 104/89

FOREIGN PATENT DOCUMENTS 4118245 12/1992 Germany ..... 104/89

*Primary Examiner*—Robert J. Oberleitner

*Assistant Examiner*—S. Joseph Morano

*Attorney, Agent, or Firm*—Cohen, Pontani, Lieberman, Pavane

[57] ABSTRACT

A rail conveyor, including an I-shaped main rail, a trolley guided at the I-shaped rail and having lateral guide rollers, a running wheel rolling on the rail, a counter-wheel and an extra rail for the counter-wheel for increasing frictional engagement of the running wheel with the main rail, the extra rail extending parallel to the main rail, the extra rail being arranged laterally adjacent to the rail, the running wheel and the counter-wheel each having an axle that lies in a plane aligned perpendicular to the longitudinal extension of the main rail.

6 Claims, 3 Drawing Sheets

OVERHEAD CONVEYOR WITH SUPPLEMENTAL WHEEL AND RAIL FOR INCREASING DRIVING TRACTION

FIELD OF THE INVENTION

The invention is directed to a rail conveyor, in particular a single-rail or monorail overhead conveyor with a trolley guided at a rail, a running wheel rolling on the rail, and a counter-wheel. An extra rail for the counter-wheel being provided to extend parallel to the rail for increasing the frictional engagement of the running wheel with the rail.

DESCRIPTION OF THE PRIOR ART

An electric overhead conveyor for transporting and positioning loads with at least one motor-driven traveling gear is known from DE 39 05 210 C2. The traveling gear is movable along a rail and is supported on this rail via a driven running wheel. Moreover, a counter-wheel which can influence the frictional engagement of the running wheel at the rail is arranged at the traveling gear. For this purpose, the counter-wheel interacts with an extra rail extending parallel to the rail. The auxiliary rail is arranged chiefly along ascending lengths of the line and above the rail.

Further, a driven trolley, in particular for a monorail overhead conveyor, is described in DE-PS 474 243. This trolley has a counter-wheel for an extra rail in addition to two running wheels arranged one behind the other as viewed in the direction of travel. The extra rail is arranged optionally above or below the rail for the running wheel.

These electric overhead conveyors of the prior art have proven disadvantageous, since the constructional height of the electric overhead conveyor is increased by arranging the extra rail above or below the rail for the running wheel of the trolley. Moreover, the contact pressure forces exerted on the counter-wheel by the extra rail only contribute partially to the increase in the frictional engagement of the running wheel, since the counter-wheel is arranged in front of or behind the running wheel as seen in the direction of travel.

SUMMARY OF THE INVENTION

Based on this prior art, the present invention has the object of providing a rail conveyor, particularly a monorail overhead conveyor with a trolley guided at a rail which enables a reliable transmission of the drive forces of the running wheels to the rail, particularly in ascending lengths of the line, and at the same time has a small constructional height.

Pursuant to this object, and others which will become apparent hereafter, one aspect of the present invention resides in a rail conveyor in which the extra rail is arranged laterally adjacent the main rail. The axles of the running wheel and the counter-wheel lie in a plane aligned perpendicular to the longitudinal extension of the main rail.

In a further embodiment of the invention the counter-wheel is supported at a rocker. The rocker is swivelable at the trolley around a swivel pin aligned parallel to the axle of the running wheel and can be adjusted in the direction of the extra rail via a spring element arranged at the trolley.

In an another embodiment of the invention the counter-wheel is arranged between the lateral guide rollers as seen in the direction of travel, which lateral guide rollers are provided on a side of the rail opposite the counter-wheel.

In yet an additional embodiment, the extra rail is arranged at the main rail by angle members.

The basic idea of the invention consists in arranging the extra rail for the counter-wheel laterally next to the I-shaped rail for the running wheel in order to minimize the constructional height of the rail conveyor. At the same time, the region located directly below the rail is kept available for the arrangement of a suspension point for load-carrying means. Further, as a result of the arrangement of the counter-wheel, according to the invention, whose axle is situated along with the axle of the running wheel in a common plane extending vertically to the longitudinal extension of the rail, the radii of curvature of the rail substantially coincide with those of the extra rail also when traveling over vertical curves, in contrast to the prior art, with leading and trailing counter-wheels, respectively, as viewed in the direction of travel. Accordingly, the follow-up or readjusting path of the rocker acted upon by a spring is minimized and the increase in the frictional engagement for the running roller due to the counter-wheel is accordingly more uniform. The moment brought about by the lateral offsetting of the counter-wheel as seen in the direction of travel is compensated for by the lateral guide rollers which act laterally on the rail.

Additionally, the arrangement of the extra rail directly at the rail proves particularly advantageous since this arrangement facilitates assembly on the one hand and simplifies the relative parallel alignment of the two rails on the other hand. The accuracy of the parallel alignment of the rails in turn leads to a uniform increase in the frictional engagement by means of the counter-wheel.

The various features of novelty which characterize the invention are pointed out with particularity in the claims annexed to and forming a part of the disclosure. For a better understanding of the invention, its operating advantages, and specific object attained by its use, reference should be had to the drawing and descriptive matter in which there are illustrated and described preferred embodiments of the invention.

DETAILED DESCRIPTION OF THE PREFERRED EMBODIMENTS

Figure 1:
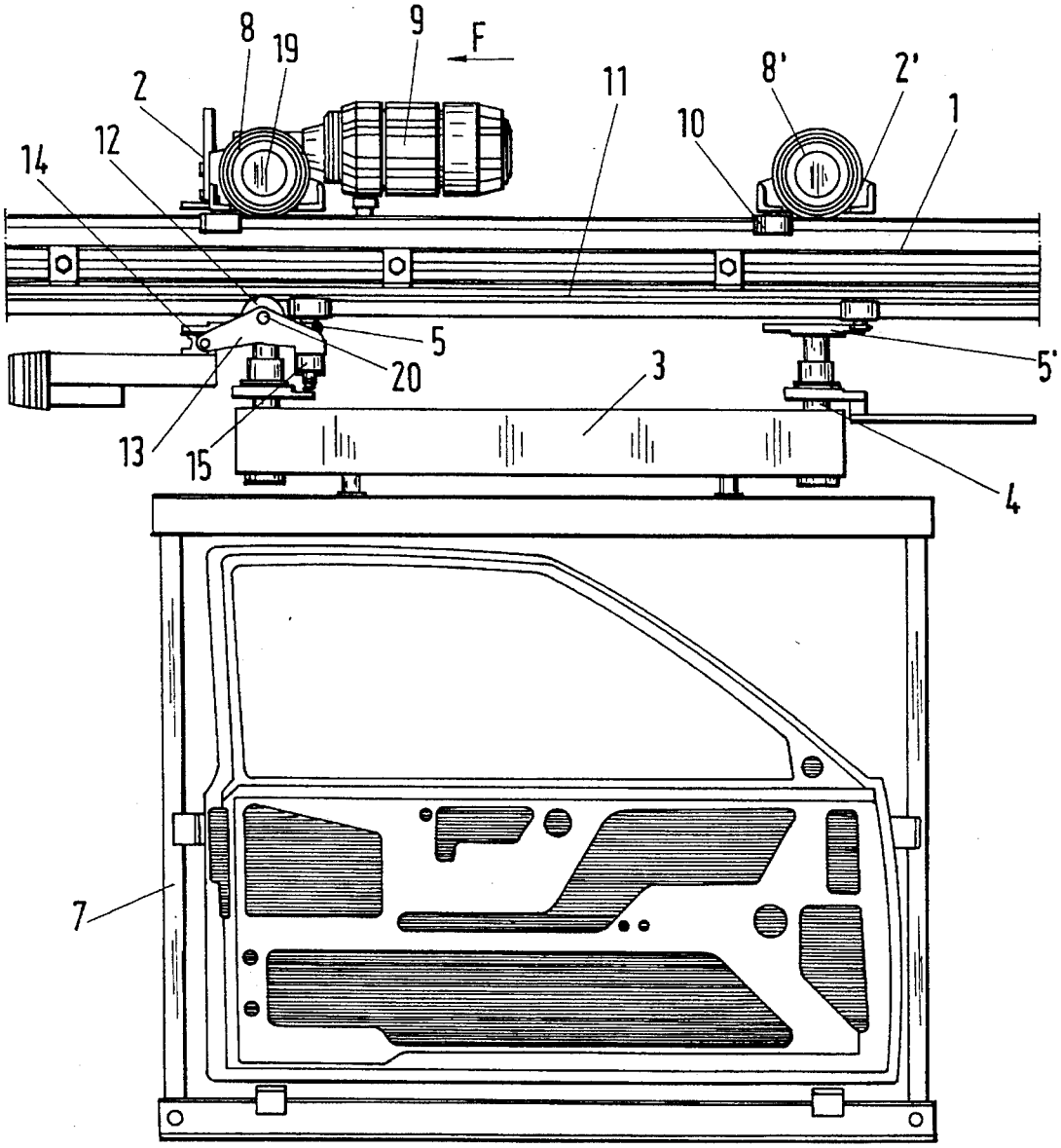
FIG. 1 shows a side view of a monorail overhead conveyor with an extra rail pursuant to the present invention.

FIG. 1 shows a side view of a rail conveyor constructed as a monorail overhead conveyor. The monorail overhead conveyor substantially includes a rail 1 on which trolleys 2, 2' are guided. Two trolleys 2, 2' are provided. These trolleys 2, 2' are arranged at intervals one after the other as seen in the direction of travel F and are connected with one another via a cross-piece 3. The cross-piece 3 is arranged below the horizontal rail 1 and connected at its ends with the front trolley 2 and the rear trolley 2' via an articulated pin or hinge pin 4 in each instance. The hinge pins 4 are aligned with their rotational axis perpendicular to the rail 1 and are supported in a base plate 5, 5' with the end remote of the cross-piece 3. The base plate 5, 5' is a structural component part of a frame 6, 6' (see FIG. 2) of the trolley 2, 2'. Furthermore, load-carrying means 7 are suspended at the cross-piece 3. In the embodiment shown, the load-carrying means 7 are constructed as a supporting frame for two motor-vehicle doors.

Moreover, it can be seen from FIG. 1 that the trolleys 2, 2' have a running wheel 8, 8' which rolls on the upper flange of the I-shaped rail 1. The running wheel 8 of the front trolley 2, as seen in the direction of travel F, can be driven via a motor 9 arranged at the frame 6. In addition, the trolleys 2, 2' are guided at the rail 1 via lateral guide rollers 10. For this purpose, two lateral guide rollers 10 are provided at each side of the rail 1. One of the lateral guide rollers 10 rolls at the upper flange of the rail 1 and the other rolls at the lower flange of the rail 1 so as to be laterally offset toward the rear.

Further, an extra rail 11 running parallel to the rail 1 is fastened to the latter. A counter-wheel 12, whose axle 20 is aligned so as to be parallel to the axle 19 of the running wheel 8, rolls at the extra rail 11 and is supported at a rocker 13. The axles 19, 20 are arranged in a plane which is aligned perpendicular to the longitudinal extension of the rail 1. The rocker 13 is swivelably supported at one end via a pin 14. The longitudinal direction of the pin 14 is aligned parallel to the axles 19, 20 of the running wheel 8 and the counter wheel 12. A spring element 15 engages at the other end of the rocker 13. The counter-wheel 12 acts on the rocker 13 in the direction of the extra rail 11 via the spring element 15.

Figure 2:
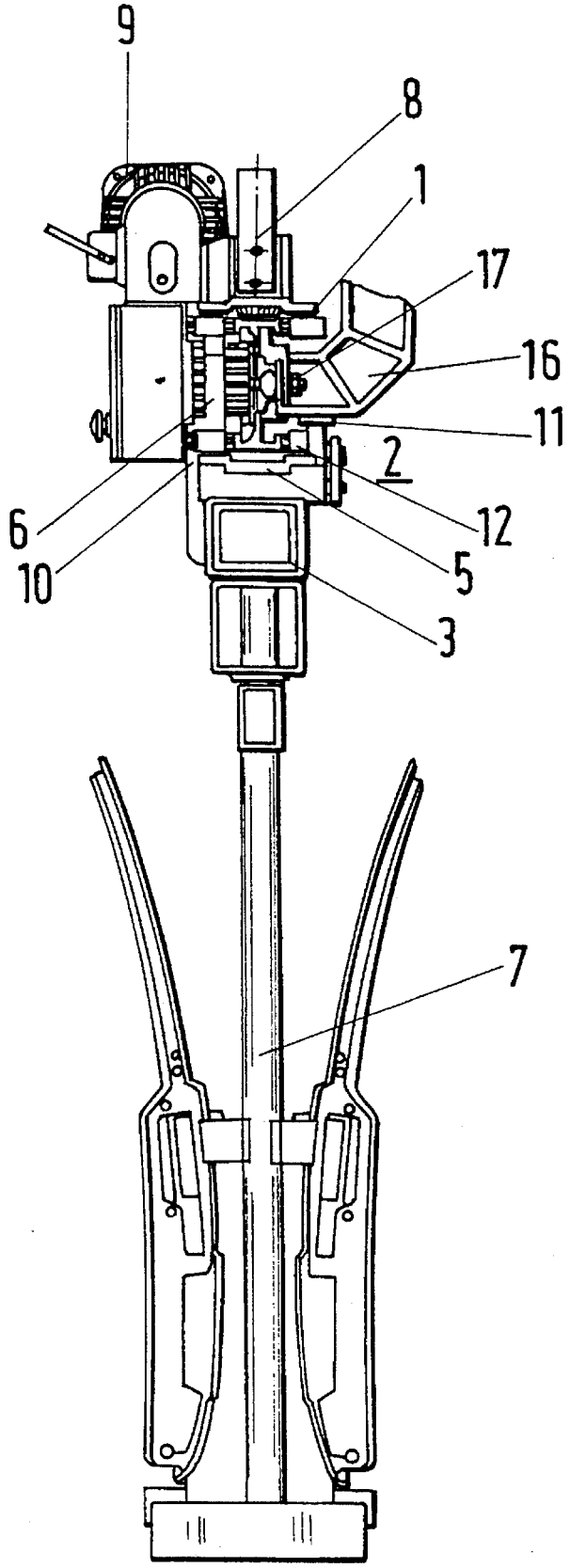
FIG. 2 shows a rear view of FIG. 1.

FIG. 2 shows a rear view of FIG. 1. It can be seen that the frame 6 of the trolley laterally embraces the rail 1 in a U-shaped manner and the running roller 8 rolls on the upper flange of the rail and the lateral guide rollers 10 roll at the sides of the upper and lower flange. The rail 1 is suspended at an indoor construction via a cantilever arm 16 which is only partly shown. Angles 17 are screwed to the web of the rail 1 (see also FIG. 4), the extra rail 11 being fastened to the free legs of these angles 17. The running surface of the extra rail 11 for the counter-wheel 12 is aligned parallel to the running surface of the running wheels 8, 8' on the rail and these two running surfaces are remote from one another.

Figure 3:
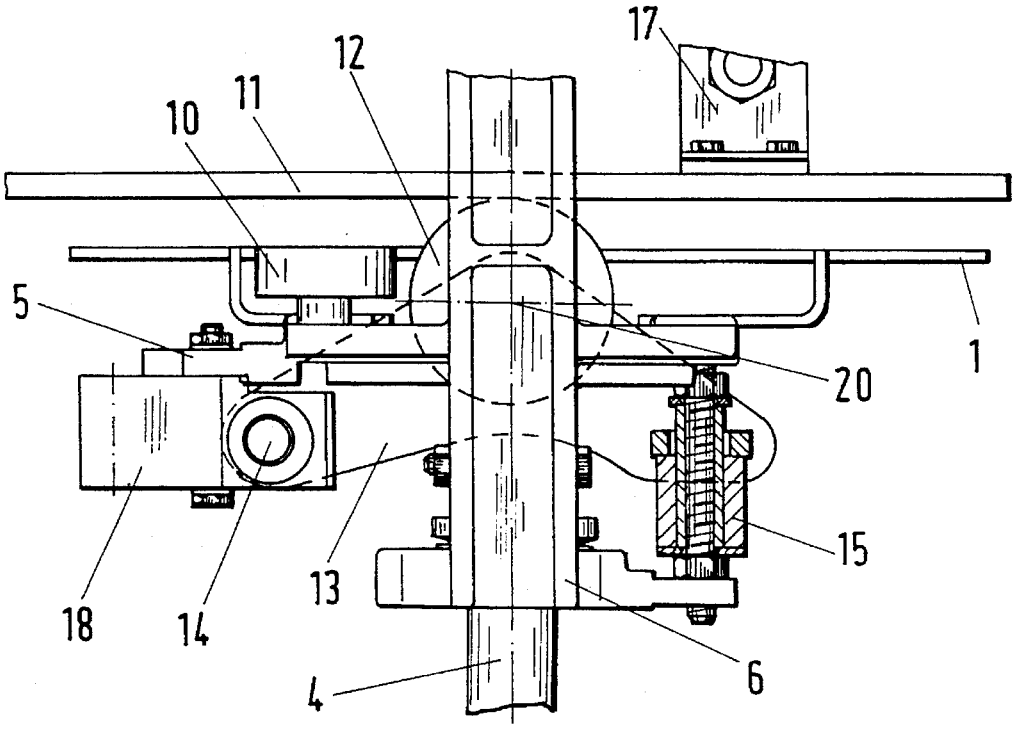
FIG. 3 shows an enlarged section from FIG. 1 in the region of the extra rail and trolley of the monorail overhead conveyor.

FIG. 3 shows an enlarged section from FIG. 1 in the region of the extra rail 11 and the rocker 13. The rocker 13 is constructed as a double lever with two legs of equal length. The counter-wheel 12 is supported in the center of the rocker 13. The pins 14 for supporting the rocker engage at one end of the rocker 13 and a spring element 15 for the springing adjustment of the counter-wheel 12 at the extra rail 11 engages at the other end of the rocker 13. The pin 14 is connected with the underside of the base plate 5 of the frame 6 of the trolley 2 via a bearing member 18. The spring element 15 is arranged between the rocker 13 and the base plate 5 and is aligned with respect to its effective direction perpendicular to the extra rail 11.

Figure 4:
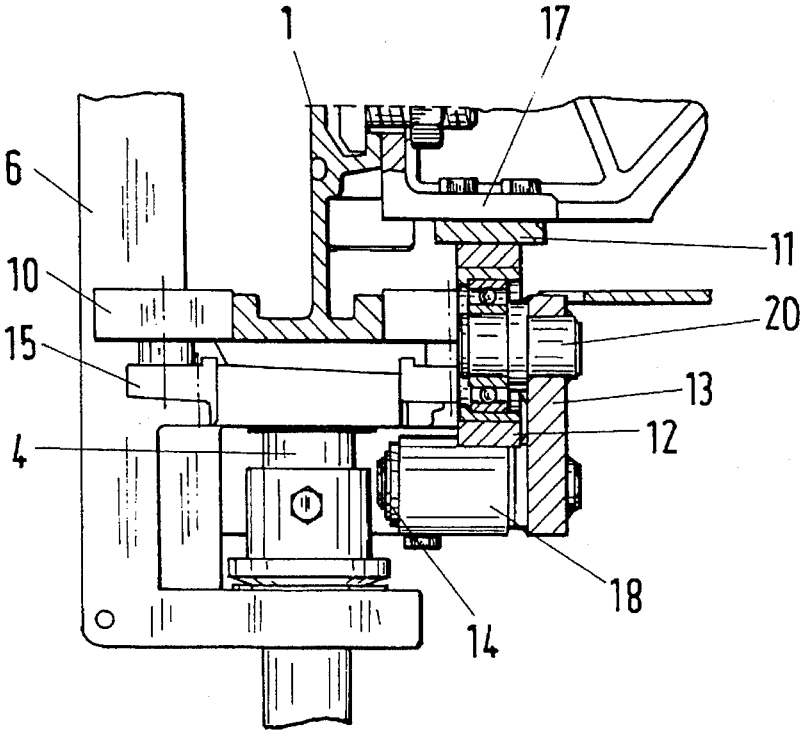
FIG. 4 shows a rear view of FIG. 3.

FIG. 4 shows a rear view of FIG. 3 which shows particularly clearly the fastening of the extra rail 11 at the angle 17 via screws. The angle 17 is screwed to the web of the rail 1.

The running surface of the extra rail 11 faces downward and the running surface is offset from the lower flange of the rail 1 in the direction of its upper flange so that the axle 20 of the counter-wheel 12 lies at the height of the lower flange of the rail 1. In addition, FIG. 4 shows that as a result of the laterally offset arrangement of the counter-wheel 12, the hinge pin 4 for fastening the cross-piece 3 for the load-carrying device 7 is arranged directly below the rail 1 while maintaining a minimum gap between the lower flange of the rail 1 and the base plate 5.

The invention is not limited by the embodiments described above which are presented as examples only but can be modified in various ways within the scope of protection defined by the appended patent claims.

I claim:

1. A rail conveyor, comprising: an I-shaped main rail having an upwardly facing running surface; a trolley guided at the I-shaped rail and having lateral guide rollers; a running wheel adapted to roll on the running surface of the main rail; a counter wheel; and an extra rail for the counter-wheel, the extra rail having a downwardly facing running surface, the counter wheel being arranged to engage the downwardly facing running surface of the extra rail so as to force the running wheel against the main rail to increase frictional engagement between the running wheel and the main rail, the extra rail extending parallel to the main rail and being arranged horizontally and laterally adjacent to the main rail and offset from a vertical plane of the main rail, the running wheel and the counter-wheel each having an axle that lies in a plane aligned perpendicular to the longitudinal extension of the main rail.

2. A rail conveyor according to claim 1, and further comprising a rocker; a swivel pin for swivelably mounting the rocker at the trolley, the swivel pin being aligned parallel to the axle of the running wheel, the counter-wheel being supported at the rocker; and spring means arranged at the trolley for adjusting the counter-wheel in the direction of the extra rail.

3. A rail conveyor according to claim 2, wherein the rocker is a double lever having two legs of equal length, the counter-wheel being supported at the center of the rocker, the swivel pin engaging one end of the rocker and the spring means engaging another end of the rocker.

4. A rail conveyor according to claim 1, wherein the counter-wheel is arranged between the lateral guide rollers as seen in the direction of travel, the lateral guide rollers being provided on a side of the main rail located opposite the counter-wheel.

5. A rail conveyor according to claim 1, and further comprising angle members connecting the extra rail to the main rail.

6. A rail conveyor according to claim 1, wherein the downwardly facing running surface of the extra rail is offset from a lower flange of the main rail.

* * * * *